US006186926B1

(12) United States Patent
Ellis

(10) Patent No.: US 6,186,926 B1
(45) Date of Patent: Feb. 13, 2001

(54) SEATED ABDOMINAL EXERCISE MACHINE

(75) Inventor: Patrick D. Ellis, Oak Creek, WI (US)

(73) Assignee: Northland Industries, Inc., South Milwaukee, WI (US)

( * ) Notice: Under 35 U.S.C. 154(b), the term of this patent shall be extended for 0 days.

(21) Appl. No.: 09/296,979

(22) Filed: Apr. 22, 1999

(51) Int. Cl.[7] ..... A63B 23/02
(52) U.S. Cl. ..... 482/97; 482/137; 482/140
(58) Field of Search ..... 482/97, 100, 136, 482/137, 140

(56) References Cited

U.S. PATENT DOCUMENTS

| | | | |
|---|---|---|---|
| 4,387,893 | | 6/1983 | Baldwin . |
| 4,627,619 | | 12/1986 | Rockwell et al. . |
| 5,005,830 | * | 4/1991 | Jones ..... 482/100 |
| 5,056,779 | | 10/1991 | Webb . |
| 5,104,121 | | 4/1992 | Webb . |
| 5,300,005 | | 4/1994 | Wang . |
| 5,330,405 | | 7/1994 | Habing et al. . |
| 5,342,269 | | 8/1994 | Huang et al. . |
| 5,554,084 | | 9/1996 | Jones . |
| 5,599,261 | | 2/1997 | Easley et al. . |
| 5,716,308 | | 2/1998 | Lee . |

* cited by examiner

*Primary Examiner*—J Mulcahy
(74) *Attorney, Agent, or Firm*—Andrus, Sceales, Starke & Sawall, LLP

(57) ABSTRACT

A seated abdominal exercise machine includes a frame, a seat mounted to the frame and a backrest attached to the frame rearwardly of the seat. An arm and head support assembly is mounted for rotary movement to the frame and provides a resistance adapted to be moved by an exerciser occupied in the seat. A motion translation arrangement is pivotally mounted between the frame and the arm and head support assembly for providing an unrestricted, full range abdominal crunching motion for the seated exerciser. The machine relies upon a series of transfer members pivotally interconnected together between the frame and the arm and head support assembly and moving about a first fixed horizontal axis passing through the backrest, a first movable horizontal axis passing through the arm and head support assembly, a second fixed horizontal axis passing through the frame at a location offset from the first fixed horizontal axis, and a second movable horizontal axis which moves rearwardly and upwardly relative to the frame when a downward force is exerted upon the arm and head support assembly.

13 Claims, 7 Drawing Sheets

SEATED ABDOMINAL EXERCISE MACHINE

BACKGROUND AND SUMMARY OF THE INVENTION

This invention relates broadly to an exercise machine and, more particularly, pertains to a seated abdominal exercise machine for performing an abdominal "crunching" motion, in which one's abdominal muscles are exercised as the spine is flexed.

Human abdominal muscles are chiefly comprised of the rectus abdominus. The rectus abdominus muscles are a pair of elongated, planar muscles, on either side of the navel, which extend along the entire length at the front of the abdomen from the lower rib cage to the pelvis. The rectus abdominus muscles are interconnected by a band of fibrous connective tissue which creates a greater abdominal region beneath the sternum.

The upper section of the rectus abdominus is known to be effectively exercised by performing repetitions of sit-ups using the "crunch" technique. In its classic context, "crunch" relates to the motion in which the human torso is raised from a lying down or supine position, that is, flexed in a curling motion, while the spine is bent and the legs are held straight or bent.

Damage to the spine can occur when the vertebrae region is subjected to stresses or forces which are inconsistent with the function of that region. Unless care is taken to completely and properly support one's back, neck and head, dangerous stress is placed on the vertebrae and discs.

To minimize the risk of injury and provide a greater level of comfort and control than that achieved from traditional free hand exercises, various devices have been proposed whereby an exerciser can perform or simulate a crunch motion while performing repetition of exercises equivalent to sit-ups or crunches, but remaining within the safe limits of stress to the back, neck and abdominal muscles.

Various resistance-type exercise devices for exercising abdominal muscles have been developed over the years. One type of device is known as a seated abdominal exercise machine. Generally, this type of machine places an exerciser in a sedentary position raised off the ground in a framework, including a rotary-type, upper torso engaging structure which allows the exerciser to bend forwardly into a simulated crunch position against a variable resistance.

Although various attempts have been made to perfect these machines, there remains several disadvantages to their design. Some of these machines emphasize motions which work the hip flexors more than the abdominal region. Other machines concentrate on moving about a particular axis or axes without fully supporting the neck, head and back. Still other versions are limited by other factors such as a limited range of movement, improper backrest and/or seat cushion design. With such predecessor designs, it was entirely possible to work the machine's mechanism with incorrect and incomplete motion because proper torso extension and contraction was not completely studied.

Accordingly, it is desirable to provide an exercise device for doing "crunches" that allows for a full range of abdominal muscle involvement while continuously supporting the neck, head and back of the exerciser. It is also desirable to provide a seated abdominal exercise machine which does not impose undue stress on the exerciser's spine and allows an effective abdominal exercising apparatus which is safe, comfortable and easy to use. It is also desirable to provide an exercise apparatus employing a motion translation arrangement for providing a true crunching motion which will strengthen and develop the entire abdominal region.

It is one object of the present invention to provide an improved apparatus for full range exercise of the abdominal muscles.

It is a further object of the present invention to provide an exercise machine for isolating and strengthening the abdominal muscles that requires the exerciser to perform correct torso extension and contraction.

It is also an object of the present invention to provide a seated exercise abdominal machine for guiding the human body through proper trunk flexion by continuous support of the head, neck and back.

A further object of the present invention is to provide an abdominal exercise machine which acts about several axes of motion to enable the proper flexing of one's spine.

Yet another object of the present invention is to provide an abdominal exercise device having a seat and a backrest located at favorable dispositions, so as to maximize the effect of the crunching motion.

In one aspect of the invention, a seated abdominal exercise machine includes a frame, a seat mounted to the frame and a backrest attached to the frame rearwardly of the seat. An arm and head support assembly is mounted for rotary movement to the frame and provides a resistance adapted to be moved by an exerciser occupied in the seat. A motion translation arrangement is pivotally mounted between the frame and the arm and head support assembly for providing an unrestricted, full range abdominal crunching motion for the seated exerciser. The motion translation arrangement includes a transfer tube having a lower end pivotally connected to the frame about a first fixed horizontal axis passing through the back rest, and an upper end pivotally mounted to the upper arm and head support assembly about a first moving horizontal axis. The motion translation arrangement further includes a transfer link having a lower end pivotally mounted to the arm and head support assembly about a second moving horizontal axis, and an upper end pivotally attached to the frame about a second fixed horizontal axis which is offset relative to the first fixed horizontal axis. The motion translation arrangement further includes a movable vertical leg extending downwardly between the arm and head support assembly and the frame, the leg providing additional resistance during the crunching motion. A structure is pivotally mounted about a third movable horizontal axis on the arm and head support assembly adapted for continuously engaging and supporting the head and neck of the exerciser throughout the full range of the exercise motion. The seat is independently adjustable and is generally declined rearwardly relative to the frame at about 35° from a horizontal plane. The backrest is fixed and is generally angularly disposed relative to the frame at about 45° from a vertical plane. The offset relationship between the first fixed horizontal axis and the second fixed horizontal axis enables the motion translation arrangement to pivot at a greater speed at the second movable horizontal axis than at the first movable horizontal axis. The arm and head support assembly includes a carriage superstructure including a horizontal cross beam having opposite ends to which are fixedly attached a pair of downwardly depending parallel arms, a pair of support braces extending forwardly from the arms for supporting a pair of cushions adapted to be engaged by the elbows of the exerciser. The cross beam includes a pair of handlebars having handle grips adapted to be grasped by the hands of the exerciser during exercise. A U-shaped bracket is pivotally mounted on the handle bars and a head support cushion is attached to the U-shaped bracket and adapted to continuously engage the head of an exerciser during the crunching motion.

The invention further relates to a seated abdominal exercise machine having a frame, a seat mounted on the frame, a back rest attached to the frame and an arm and head support assembly mounted for rotary movement to the frame. The improvement resides in a motion translation arrangement including a series of transfer members pivotally interconnected together between the frame and the arm and head support assembly and moving about a first fixed horizontal axis passing through the backrest, a first movable horizontal axis passing through the arm and head support assembly, a second fixed horizontal axis passing through the frame at a location offset from the first fixed horizontal axis, and a second movable horizontal axis which moves rearwardly and upwardly relative to the frame when a downward force is exerted on the arm and head support assembly. The second fixed horizontal axis is offset above and to the rear of the first fixed horizontal axis. The machine includes a one-piece, flat back rest adapted for continuously supporting the back of an exerciser. A head support is pivotally mounted on the arm and head support assembly and adapted for continuously supporting and adjusting the head of an exerciser during use of the exercise machine.

In another aspect of the invention, an abdominal exercise machine is provided in which the torso of an exerciser is adapted to be flexed. The exercise machine includes a frame, a seat adjustably mounted on the frame, and a backrest mounted to the frame and adapted for continuously supporting the back of an exerciser occupied in seat of the machine. A carriage superstructure is pivotally mounted on the frame and includes a pair of pads adapted to be engaged by the elbows of the exerciser. A motion translation arrangement is pivotally mounted between the frame and the carriage superstructure for enabling unlimited range of abdominal motion. A mechanism is pivotally mounted on the carriage superstructure and adapted to continuously support and adjust an exerciser's head throughout the range of abdominal motion, so that the head will move in a manner consistent with the flexing of the torso.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
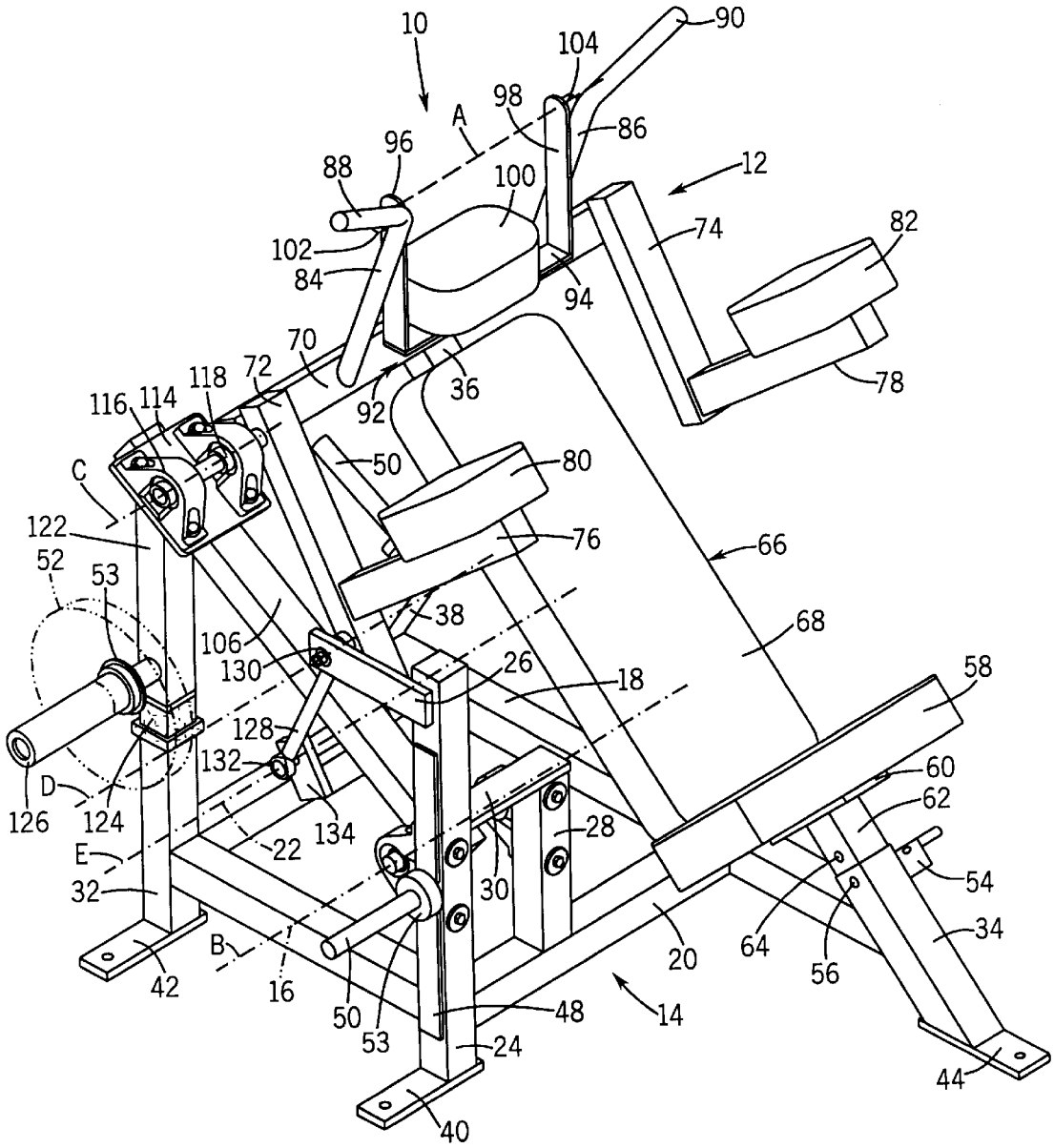
FIG. 1 is a front perspective view of the seated abdominal exercise machine employing the present invention.
Figure 2:
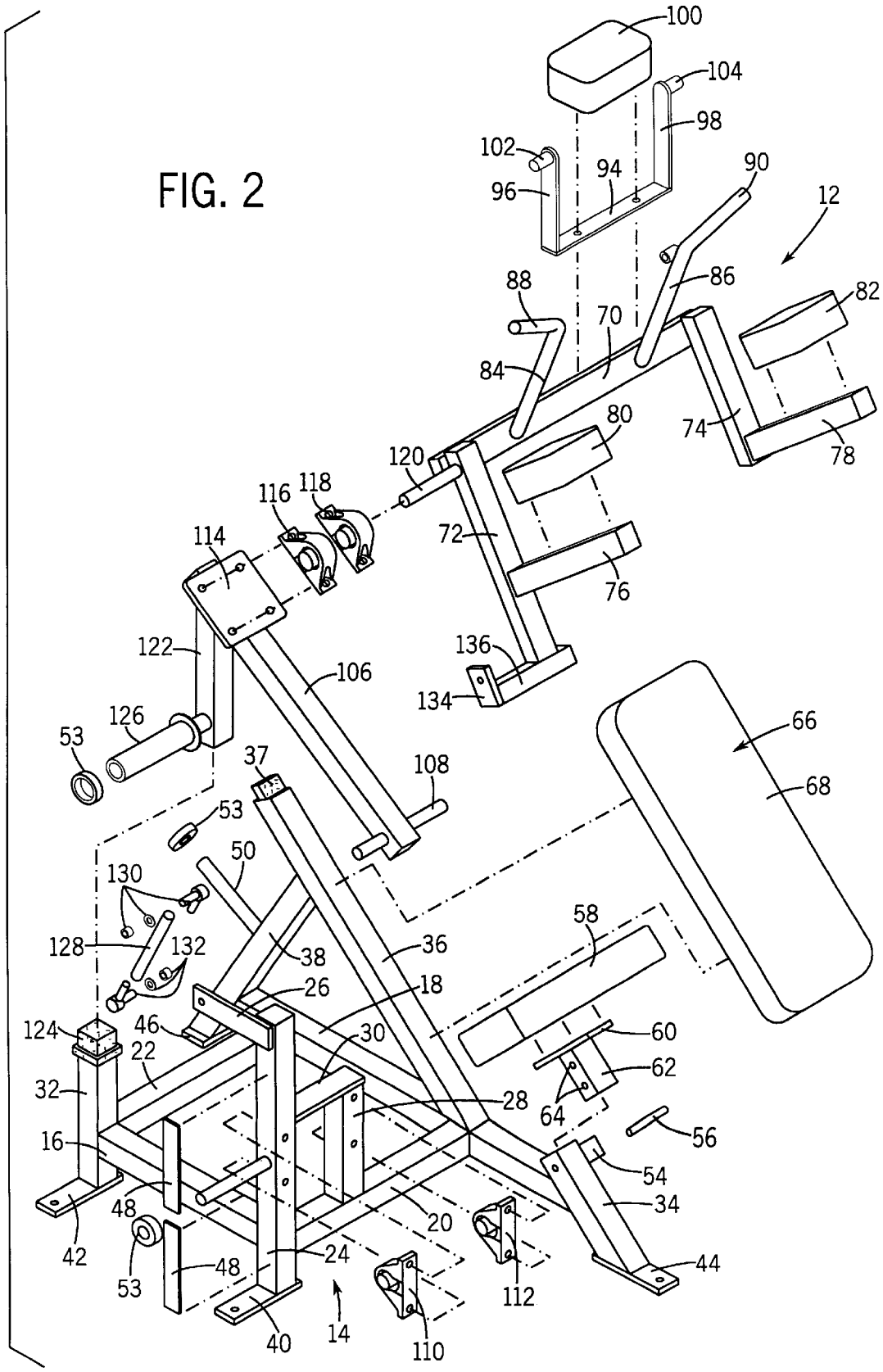
FIG. 2 is an exploded view of the machine shown in FIG. 1.
Figure 3:
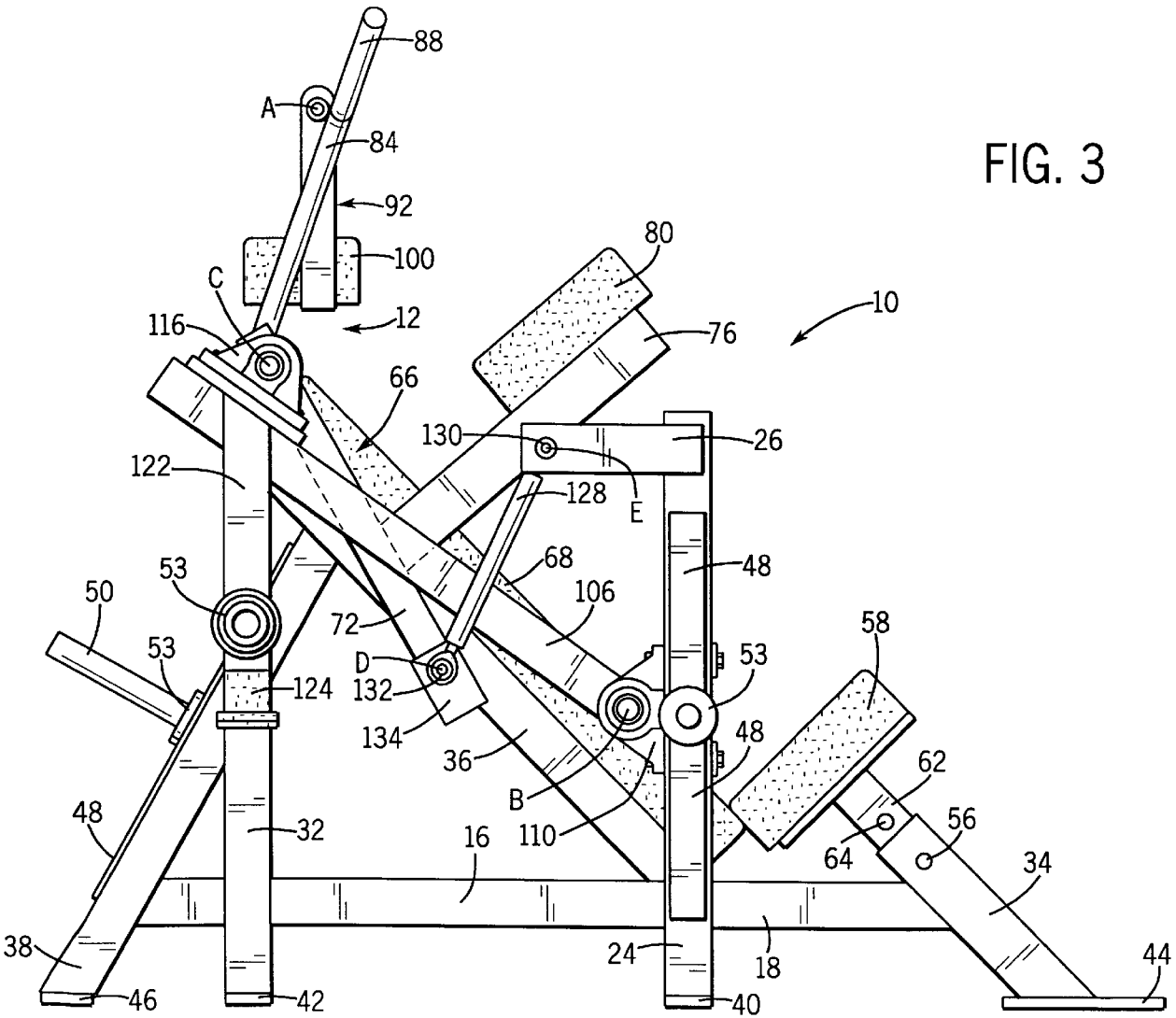
FIG. 3 is an elevational view of FIG. 1.
Figure 4:
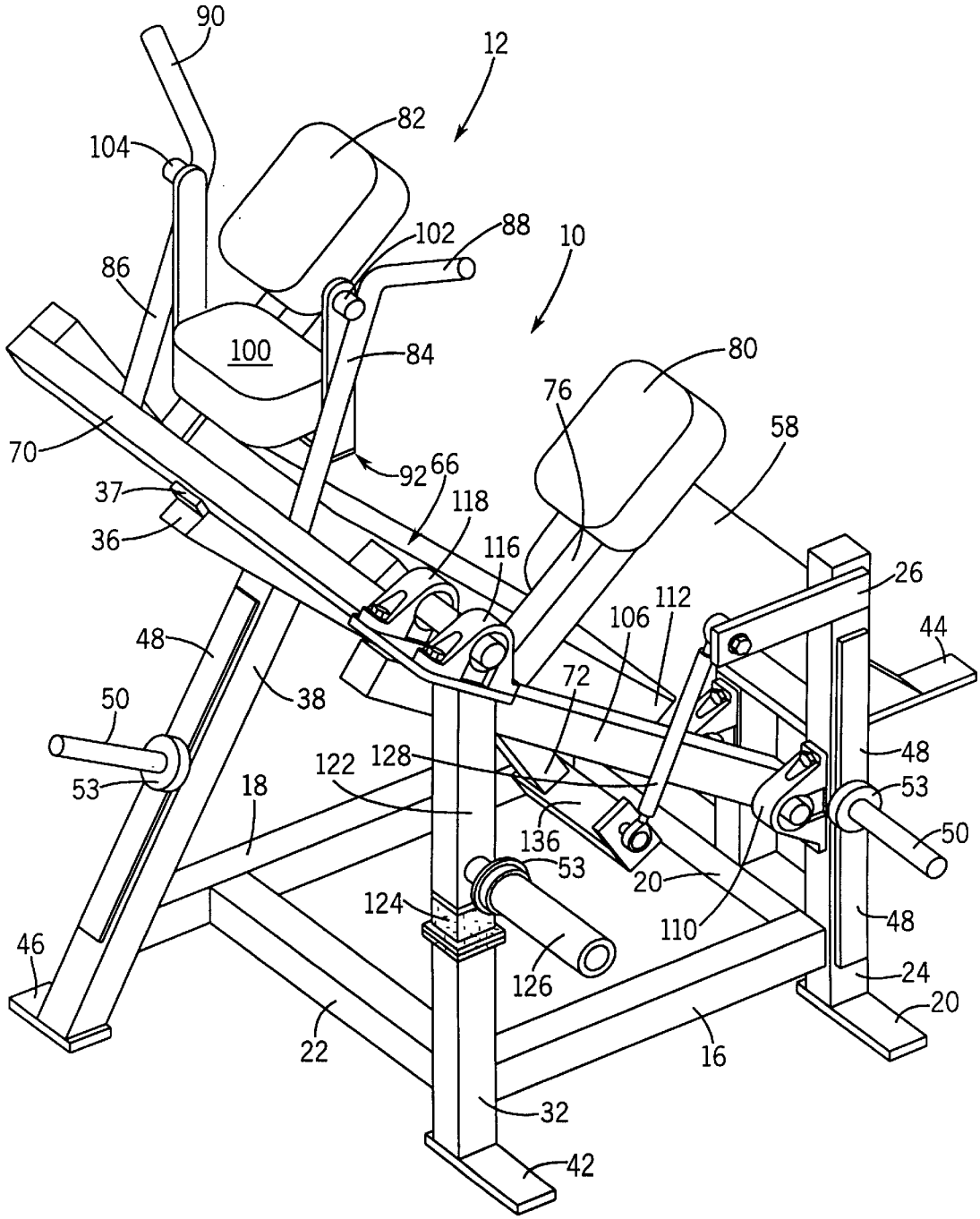
FIG. 4 is a perspective view taken from the rear corner of FIG. 1.
Figure 5:
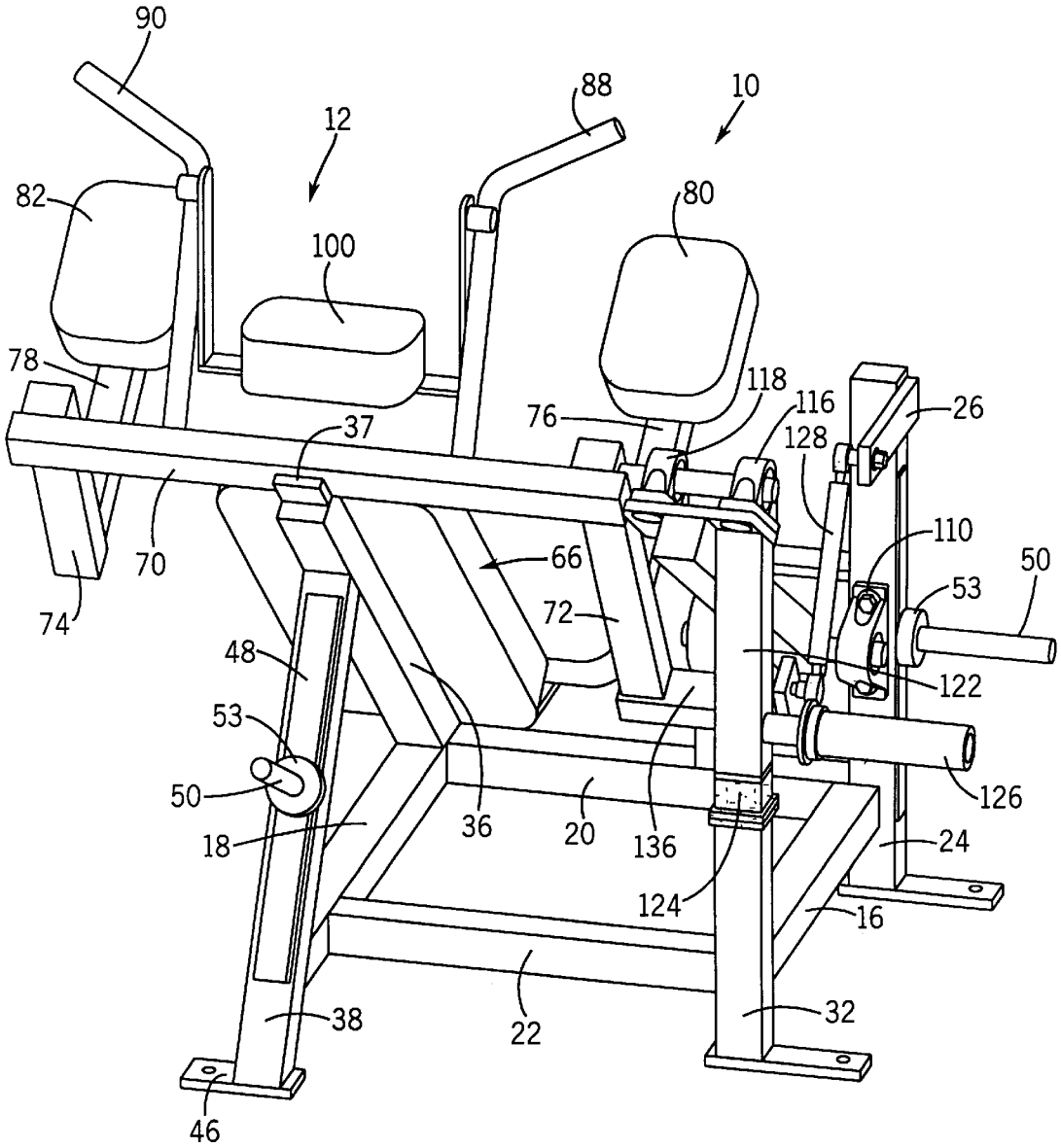
FIG. 5 is a rear perspective view of FIG. 1.

FIGS. 1–7 illustrate a seated abdominal exercise machine 10 provided with a multi-axis, motion translation arrangement for effectively moving an arm and head support assembly 12 through a guided path of travel so as to simulate an abdominal crunch motion from a raised, sedentary position.

The machine 10 includes a frame 14 preferably constructed of a series of straight sections of heavy-duty, tubular steel which are welded together. In particular, the frame 14 comprises a pair of parallel, horizontal base members 16,18 and a pair of parallel front and rear transverse members 20,22 respectively. An elongated front upright 24 is secured perpendicularly to base member 16 at front transverse member 20, and is provided with a rearwardly extending mounting plate 26. A mounting upright 28 projects vertically from the top surface of front transverse member 20 and is joined to front upright 24 by a bridging plate 30. A rear upright 32, which is shorter in length than front upright 24 extends at right angles to base member 16 at rear transverse member 22. Base member 18 is substantially longer than opposed base member 16 and is joined in orthogonal relation to the front and rear transverse members 20,22 respectively. A front end of base member 18 is connected to an angular, tubular front leg 34 which rises upwardly and rearwardly therefrom. Spaced rearwardly from front leg 34 and fixed to a top surface of base member 18 is an angularly disposed support tube 36 which rises upwardly and rearwardly at generally the same angle as front leg 34. Support tube 36 has an upper end provided with a cushioned stop 37 against which a portion of the arm and head support assembly 12 normally rests. A rear end of the base member 18 is fixed to a sloping strut 38 which ascends upwardly and forwardly for joinder at a top end to an underside of support tube 36. The dimensions of the structural components described above are suitably chosen to establish a reasonably-sized footprint which reflects the space efficiency of the machine 10. In the preferred embodiment, the maximum width and depth dimensions as defined by frame 14 are forty-five inches and forty-eight inches, respectively.

To lend proper stability, the bottom ends of uprights 24,32, leg 34 and strut 38 are provided with welded bottom plates or feet 40,42,44, and 46, respectively. These feet may be apertured to receive bolts and facilitate securement of machine 10 to a supporting surface, such as a gym or a home floor. An outer surface of front upright 24 and a rear surface of strut 38 are each equipped with a protective strip 48 and an outwardly projecting, cylindrical, weight storage peg 50 which serves to support at least one removable weight plate 52, shown in phantom lines of FIG. 1. Each peg 50 includes a cylindrical rubber ring 53 for cushioning and spacing the weight plate 52 away from the respective upright 24 and strut 38. Tubular front leg 34 carries a spring set device 54 having a movable positioning pin 56 which provides for the upward and downward adjustability of a cushioned seat 58. The seat 58 is mounted on a plate end 60 of a downwardly and forwardly projecting support post 62 which is slidably accommodated in the tubular leg 34. Appropriately aligned openings 64 formed in the tubular leg 34 receive the positioning pin 56. The seat 58 is adapted to be adjustably disposed at various heights using pin 56 and openings 64 so as to provide a comfortable operating position for an exerciser, and allow a full range of motion for users of various physical size. A padded one-piece backrest 66 is fixedly joined to the angularly disposed support tube 36 above seat 58 so that during exercise one occupies a sedentary position in a partially reclined orientation. Backrest 66 has a back engaging flat surface 68 for continuously supporting a user's entire back when in the starting, exercising position of FIG. 6, and at least a lower half of the user's back when in the "crunched" position of FIG. 7. The seat 58 and the backrest 66 combine to create a support system for ensuring both the comfort and the proper positioning of the user during exercise. Typically, the seat 58 is declined rearwardly at an angle of about 35° from horizontal, while the backrest 66 is disposed at an angle of about 45° from the vertical.

Figure 6:
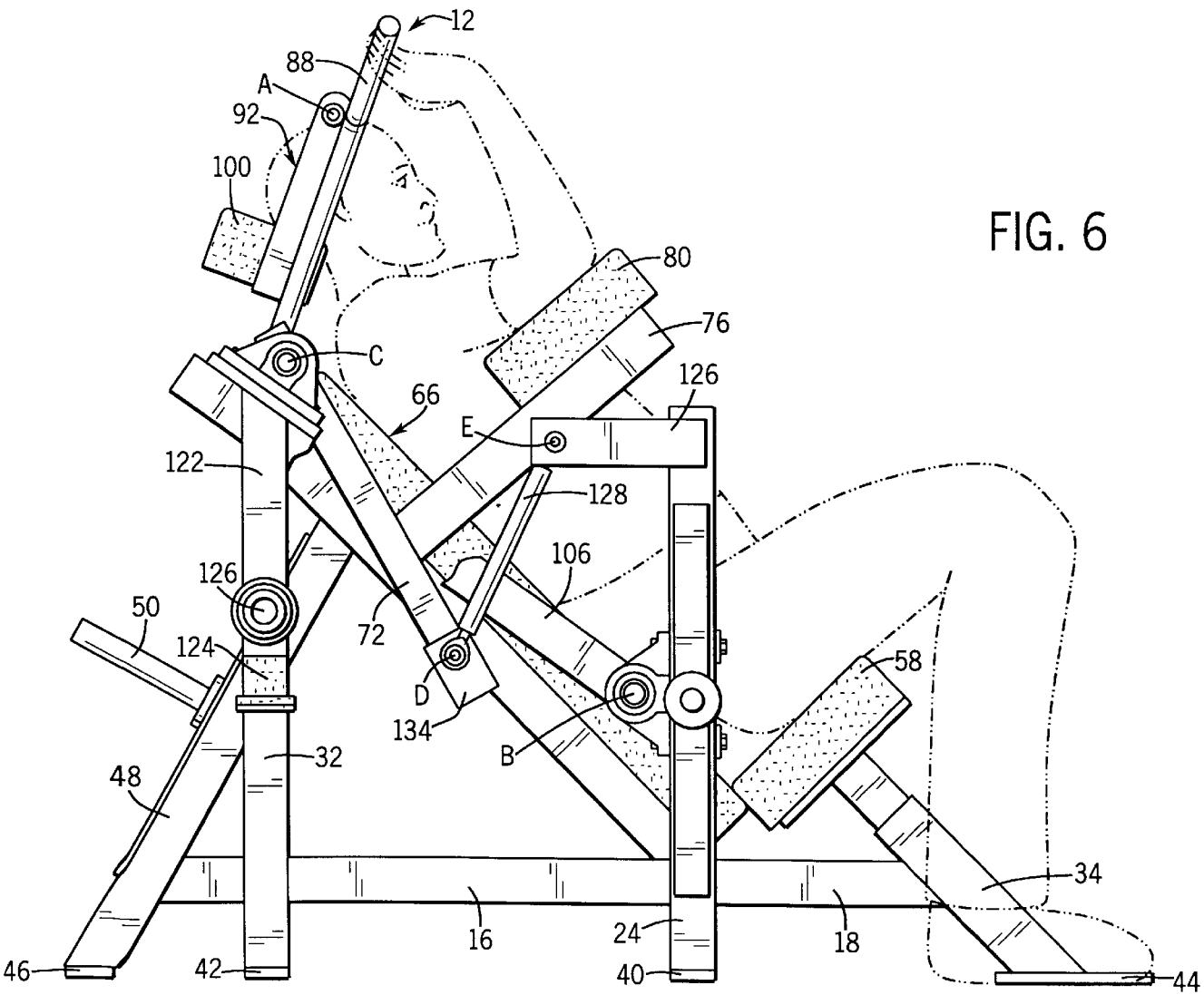
FIG. 6 is a view like FIG. 3 showing the exerciser in a torso stretched or extended position.
Figure 7:
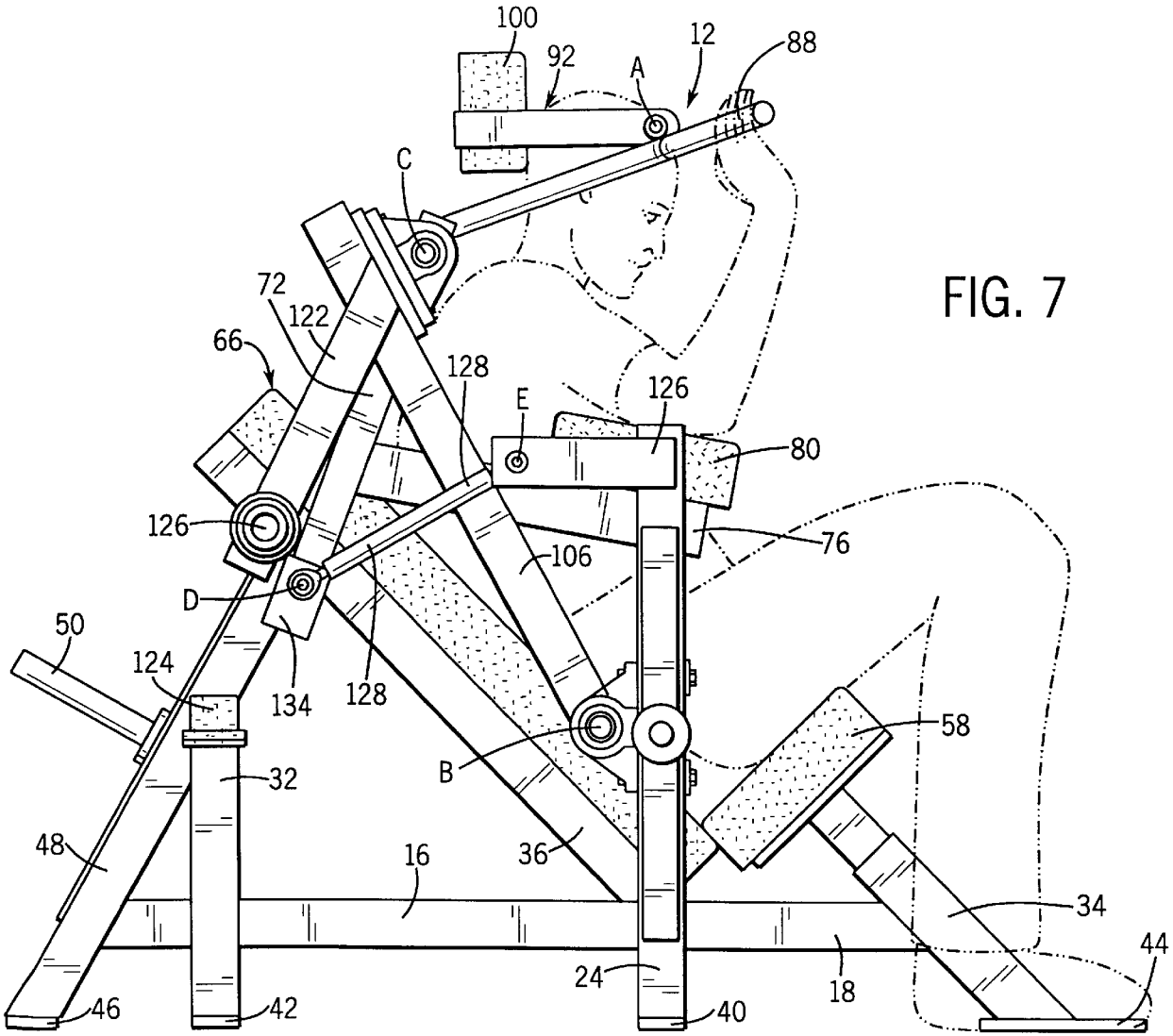
FIG. 7 is a view like FIG. 3 showing the exerciser in a torso flexed or contracted position.

The arm and head support assembly 12 is designed for engagement with the hands and arms, as well as the head of an exerciser as he or she moves from a torso extended position (FIG. 6) to a torso contracted position (FIG. 7). That is, a downward force imparted by the hands and arms will move the arm and head support assembly 12 over a curved path of travel and in a manner which will bring the entire abdominal area into use. Throughout the abdominal exercise, the head is movably supported so that it is correctly aligned with the flexing of the spine. As will be appreciated hereinafter, the arm and head support assembly 12 is pivotally moved relative to frame 14 about a pair of fixed horizontal axes and three moving horizontal axes.

The arm and head support assembly 12 takes the form of a carriage superstructure including a horizontal cross beam 70 which is supported by and is quietly engageable with the stop 37 on support tube 36. The cross beam 70 has welded at opposite ends thereof, upper ends of a pair of parallel arms 72,74 depending downwardly and forwardly therefrom. The arms 72,74 are of a dissimilar length for a reason to be understood below, but share a common function in supporting a pair of upwardly and forwardly extending support braces 76,78 on the respective upper surfaces of which are mounted, such as by fasteners, a pair of elbow engaging cushions 80, 82. A pair of spaced apart handlebars 84,86 project upwardly and slightly forwardly from cross beam 70 and include forwardly, outwardly, and upwardly extending handle grips 88,90. A swingable, rigid, U-shaped mounting bracket 92 has a bight portion 94 and a pair of parallel side arms 96,98. A head support cushion 100 is fixed by suitable retainers to an upper surface of the bight portion 94 and the upper ends of the side arms 96,98 are pivotally mounted at 102,104 to the handlebars 84,86. The pivot points 102,104 help define a first movable horizontal axis A which forms a unique part of the invention. With this construction, the head support cushion 100 will continuously support and self-adjust to the back of the head as the exerciser simultaneously grasps the handlebars 84,86 and imparts a downward force from his or her elbows upon the cushions 80,82. The movable head support structure complements the flexing of the exerciser's vertebrae provided by the multi-axis, motion translation arrangement of the arm and head support assembly 12 to be detailed hereafter.

In accordance with the invention, the abdominal exercise machine 10 provides a motion translation arrangement having a respective fixed and moving horizontal axis disposed behind a back-engaging surface 68 of back rest 66 for reciprocally moving the arm and head support structure 12 relative to frame 14 in a prescribed path of travel which will result in proper flexing of the spine and full contraction of the abdominal muscles.

In the preferred embodiment, the motion translation arrangement includes a transfer tube 106 having a lower end and an upper end, both of which are adapted to be mounted about respective fixed and moving horizontal axes B and C (FIGS. 1, 3, 6 and 7). In particular, the lower end of transfer tube 106 carries a first horizontally disposed, cylindrical shaft 108 (FIG. 2), mounted for pivotal movement in respective lower pillow block bearings 110,112 typically attached by bolts, nuts and washers to respective rear surfaces of front upright 24 and mounting upright 28. The upper end of transfer tube 106 has a planar connector plate 114 for mounting a pair of upper pillow block bearings 116,118 thereon with another set of fasteners similar to those used to connect the lower bearings 110,112. The upper bearings 116,118 rotatably receive a second horizontally disposed, cylindrical shaft 120 extending outwardly and laterally from the upper end of arm 72 of the arm and head support assembly 12. It should be appreciated that the longitudinal axis of shaft 108 defines fixed horizontal axis B, while the longitudinal axis of shaft 120 forms movable horizontal axis C. Depending downwardly from the connector plate 114 is a vertical leg 122 having a bottom end adapted to normally rest squarely upon a rubber end piece 124 fixed to the top end of rear upright 32. The leg 122 also includes a laterally extending, cylindrical horn 126 for supporting one or more weight plates like 52 thereon. Again, a rubber ring 53 is employed to cushion and space the weight plate 52 from the rear upper upright 32 and the vertical leg 122.

The motion translation arrangement further includes a rod-like, tubular transfer link 128 having an upper end pivotally secured to a stub shaft assembly 130 (FIG. 2) to mounting plate 26 atop front upright 24. Transfer link 128 also has a lower end which is pivotally attached by another stub shaft assembly 132 to a vertically extending end plate 134 on a foot tube 136 welded perpendicularly to the extended bottom of arm 72. Pivot stub shafts 130 and 132 help define a respective moving horizontal axis D and a fixed respective horizontal axis E.

In typical use, one or more weight plates 52 are transferred from a weight storage device such as from pegs 50 on front upright 24 and/or sloping strut 38 to the weight horn 126 on the vertical leg 122. It should be clearly understood, however, that it is not absolutely necessary to employ a weight plate 52 on horn 126 and that an exerciser may feel the effect of the machine by resisting against the inherent weight of the assembly and the components of the motion translation arrangement. The exerciser adjusts the height of the seat 58 relative to tubular leg 34 using the spring set device 54. In the chosen seating position, the exerciser sits with his or her back completely supported by back rest 66 with hands extending upwardly grasping the handle grips 88,90 and elbows resting on the cushions 80,82. In addition, it is important to note that the back of the head is continuously supported by movable head support cushion 100. This starting exercise orientation, as depicted in FIG. 6, defines a torso extended position, in which the abdominal muscles are generally stretched. It should be appreciated that in the torso extended position, the length of the back rest 66 and the adjustability of the seat 58 are designed so as to accommodate the vast majority of abdominal exercisers. It should be further understood that the exerciser's feet are usually positioned flat in the general vicinity and on either side of the foot 44, as shown in FIG. 6. Such foot position has been found to provide a full range of abdominal exercise movement. However, the exerciser may obtain different results by placing his or her feet in an extended position in front of the machine 10. With the exerciser in the torso extended position of FIG. 6, cross beam 70 rests on cushioned stop 37 at the top of support tube 36 and the bottom of vertical leg 122 is supported on end piece 124.

With his/her hands remaining engageable with grips 88,90, the exerciser pushes downwardly and forwardly with the elbows, so as to move the arm and head support assembly 12 to a torso flexed or contracted position shown in FIG. 7, wherein the exerciser is forwardly "crunched". That is, the motion translation arrangement of the present invention will allow for moving the carriage 12 over a guided, curved path, as dictated by the lengths, locations and pivot motion of the transfer tube 106 and the transfer link 128. In particular, the head cushion 100 will swing about moving horizontal axis A as transfer tube 106 pivots forwardly about fixed horizontal axis B. At the same time, vertical leg 122 will also swing rearwardly and upwardly about moving horizontal axis C. Transfer link 128 will also translate rearwardly and upwardly about moving horizontal axis D and fixed horizontal axis E. At the same time arm 72 is caused to swing rearwardly and upwardly about pivot axis C. The exerciser reciprocates back and forth between the dotted line positions of FIG. 6 and FIG. 7 for whatever number of repetitions is desired.

During the exercise movement, it is emphasized that the lower half of the exerciser's torso is always supported along at least a lower half thereof. Of equal importance is the movable head cushion 100 which maintains the head and upper neck area is a continuous, self-adjusting motion so that the upper spine curves and flexes corresponding to the moving vertebrae in the middle back. Also it should be recognized that because of the offset nature of the horizontal axis E, with respect to horizontal axis B, the motion translation arrangement is caused to rotate at a greater speed at a horizontal axis D than at a horizontal axis C, forcing the exerciser into the crunching position.

What is unique about the present invention is that even though the machine pivots about the fixed horizontal axis B, which appears to be generally disposed in the vicinity of the pelvic area of the exerciser, the motion translation arrangement enables the outer end of the grips 88,90 to move from a first position in FIG. 6, to a second position shown in FIG. 7 over a proscribed path of travel. Such path of travel has been determined by actual modeling a seated abdominal exerciser performing an idealized crunching motion which involves movement of the majority of abdominal muscles. By photographing each small phase of movement, the machine was carefully designed to offer the desired crunching motion by meticulous experimentation with seat and back rest angles, and the length, position and movement of the components embodying motion transfer arrangement. Care was also directed to studying the flexing of the spine throughout the entire exercise motion. Many modifications of the pivoting head support cushion 100 were employed in an attempt to find an extremely safe and comfortable structure which would continually support the head and neck therefrom throughout the entire exercise to allow proper flexing of the upper back while the lower back is fully maintained against the back rest 66.

Unlike prior art seated abdominal exercise apparatus, the resulting machine of the present invention avoids the use of a two-piece contoured back panel which has been found undesirable for two reasons. First, the use of the contoured back rest is not universally applicable for the support of user's of various sizes. With this broken design, an exerciser's back is not fully supported, particularly in the midback area. Secondly, the upper back pad is not intended to pivot against the user's upper back as the exerciser moves forwardly, it has been found that this moveable upper back pad forces the flexing of the upper pad leaving the head and neck totally unsupported at all times. The present invention also deviates from prior art abdominal exercise apparatus, by disposing the exerciser at a rearwardly declined seated position which will necessitate the exerciser moving forwardly over a greater range of motion than previously so as to more fully exercise the abdominals while the spine, head and neck regions are fully supported. In contrast with known devices, the present invention purposely does not have a range limiting structure for restricting motion of the exercise.

It should be appreciated that the present invention provides an ergonometric seated abdominal exercise machine employing a motion translation arrangement for performing a full range crunching motion using the abdominal muscles.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth in the following claims.

I claim:

1. A seated abdominal exercise machine comprising:

a frame;

a seat mounted to the frame;

a backrest attached to the frame rearwardly of the seat;

an arm and head support assembly mounted for rotary movement to the frame and providing a resistance adapted to be moved by an exerciser occupied in the seat; and a motion translation arrangement including:

a transfer tube having a lower end pivotally mounted to the frame about a first fixed horizontal axis passing through the backrest, and an upper end pivotally mounted to the upper arm and head support assembly about a first moving horizontal axis; and a transfer link having a lower end pivotally mounted to the arm and head support assembly about a second moving axis, and an upper end pivotally attached to the frame about a second fixed horizontal axis which is offset relative to the first fixed horizontal axis.

2. The machine of claim 1, wherein the motion translation arrangement further includes a movable vertical leg extending downwardly between the arm and the head support assembly and the frame, the leg providing additional resistance during the crunching motion.

3. The machine of claim 1, including a structure pivotally mounted about a third movable horizontal axis on the arm and head support assembly adapted for continuously engaging and supporting the head and neck of the exerciser throughout the full range of the exercise motion.

4. The machine of claim 1, wherein the seat is independently adjustable and is generally declined rearwardly relative to the frame at about 35° from the horizontal plane and the backrest is fixed and generally angularly disposed relative to the frame at about 45° from a vertical plane.

5. The machine of claim 2, wherein the offset relationship between the first fixed horizontal axis and the second fixed horizontal axis enables the motion translation arrangement to pivot at a greater speed at the second movable horizontal axis than at the first movable horizontal axis.

6. The machine of claim 1, wherein the arm and head support assembly includes a carriage superstructure including a horizontal cross beam having opposite ends to which are fixedly attached a pair of downwardly depending parallel arms, a pair of support braces extending forwardly from the arms for mounting a pair of cushions adapted to be engaged by the elbows of an exerciser.

7. The machine of claim 6, wherein the cross beam includes a pair of handle bars having handle grips adapted to be grasped by the hands of the exerciser during exercise.

8. The machine of claim 7, including a U-shaped bracket pivotally mounted on the handle bars and a head support cushion attached to the U-shaped bracket and adapted to continuously engage the head of an exerciser during the crunching motion.

9. In a seated abdominal exercise machine having a frame, a seat mounted on the frame, a backrest attached to the frame, and an arm and head support assembly mounted for rotary movement to the frame, the improvement residing in:

a motion translation arrangement including a series of transfer members pivotally interconnected together between the frame and the arm and head support assembly and moving about a first fixed horizontal axis passing through the backrest, a first movable horizontal axis passing through the arm and head support assembly, a second fixed horizontal axis passing through the frame at a location offset from the first fixed horizontal axis, and a second movable horizontal axis such that the second moves rearwardly and upwardly relative to the frame when a downward force is exerted on the arm and head support assembly.

10. The improvement of claim 9, wherein the second fixed horizontal axis is offset above and to the rear of the first fixed horizontal axis.

11. The improvement of claim 9, including a one-piece, flat backrest adapted for continuously supporting the back of an exerciser.

12. The improvement of claim 9, including a head support pivotally mounted on the arm and head support assembly and adapted for continuously supporting and adjusting the head of an exerciser during use of the exerciser machine.

13. A seated abdominal exercise machine comprising:

a frame;

a seat mounted to the frame;

a backrest attached to the frame rearwardly of the seat;

an arm and head support assembly mounted for rotary movement to the frame and providing a resistance adapted to be moved by an exerciser occupied in the seat;

a motion translation arrangement pivotally mounted between the frame and the arm and head support assembly for providing an unrestricted, full range abdominal crunching motion for the seated exerciser;

the arm and head support assembly including a carriage superstructure including a horizontal cross beam having, the cross beam including a pair of handle bars having handle grips adapted to be grasped by the hands of the exerciser during exercise; and a bracket pivotally mounted to the handlebars and a head cushion attached to the bracket and adapted to continuously engage the head of an exerciser during the crunching motion.

* * * * *

UNITED STATES PATENT AND TRADEMARK OFFICE

CERTIFICATE OF CORRECTION

PATENT NO. : 6,186,926 B1
DATED : February 13, 2001
INVENTOR(S) : Patrick D. Ellis It is certified that error appears in the above-identified patent and that said Letters Patent is hereby corrected as shown below:

Column 9,
Line 17, at "second", add ---movable horizontal axis---

Signed and Sealed this

Seventh Day of August, 2001

*Attest:*

Nicholas P. Godici

NICHOLAS P. GODICI
*Acting Director of the United States Patent and Trademark Office*

*Attesting Officer*